US006120024A

United States Patent [19]

Lind

[11] Patent Number: 6,120,024

[45] Date of Patent: Sep. 19, 2000

[54] AUTOMATED BALL DRAWING APPARATUS AND METHOD

[75] Inventor: Jefferson C. Lind, Austin, Tex.

[73] Assignee: Multimedia Games, Inc., Austin, Tex.

[21] Appl. No.: 09/272,135

[22] Filed: Mar. 19, 1999

[51] Int. Cl.[7] ..... A63F 3/06

[52] U.S. Cl. ..... 273/144 R; 273/144 A; 273/144 B; 463/22

[58] Field of Search ..... 273/144 R, 144 A, 273/144 B, 138.1, 138.2, 138.4, 139, 142 B, 269; 463/16, 17, 18, 19

[56] References Cited

U.S. PATENT DOCUMENTS 4,989,873 2/1991 Manabe ..... 273/142 R
5,590,879 1/1997 Tripp .
5,743,526 4/1998 Inoue ..... 273/144 R
5,799,940 9/1998 Tripp ..... 273/144 R

*Primary Examiner*—Jessica J. Harrison
*Assistant Examiner*—Julie Kasick
*Attorney, Agent, or Firm*—Russell D. Culbertson; Shaffer & Culbertson, LLP

[57] ABSTRACT

A ball drawing apparatus for drawing a series of balls at random includes a transport arrangement (10) for receiving the series of balls (15) and positioning each ball in a reading position. Each ball (15) includes a transponder (46) which is adapted to transmit an identifying signal when energized by an energizing signal. The identifying signal may be used to identify the particular ball (15) and provide a number or other symbol which is printed on the ball. A reader unit (12) includes a transmitter/receiver (41) and antenna (25) combination which transmits the energizing signal to each ball (15) as the respective ball passes through the reading position, and then receives the resulting identifying signal transmitted from the respective ball transponder (46). The transmitter/receiver (41) communicates the identifying signal to a control system (14) which displays the symbol of the identified ball. Control system (14) controls the operation of all elements of the ball drawing apparatus.

14 Claims, 4 Drawing Sheets

AUTOMATED BALL DRAWING APPARATUS AND METHOD

TECHNICAL FIELD OF THE INVENTION

The invention relates to ball drawing devices used in playing games of chance. More particularly, the invention relates to an automated ball drawing apparatus and method for drawing balls at random from a large population and rapidly identifying the drawn balls.

BACKGROUND OF THE INVENTION

Many games of chance utilize randomly drawn balls or other articles in the play of the game. For example, in bingo-type games, players are issued cards having a series of printed symbols which are selected from a large set of available symbols. Each of the symbols from the large set of symbols is also printed on a ball. The game operator randomly draws balls from a mixer and the players play the game by marking each match between a drawn symbol and a symbol on their playing card. The winning player is the first to achieve a certain pattern of matched symbols on their playing card.

Bingo-type games may be played with an operator manually drawing balls from a mixer and announcing the symbol printed on the drawn ball. This manual drawing process is slow and presents an opportunity for tampering with the outcome of the game. Also manually announcing the drawn symbols may lead to errors in the play of the game.

Automated ball drawing devices have been proposed to avoid some of the problems associated with manually drawing balls for the play of bingo-type games. These automated ball drawing devices included a ball drawing component and an identifying component for identifying the symbols printed on each drawn ball. These prior automated ball drawing devices tend to be slow and require expensive and unreliable identification components.

SUMMARY OF THE INVENTION

It is an object of the present invention to provide an automated ball drawing apparatus which rapidly draws and identifies balls for use in playing a game of chance. It is also an object of the invention to provide a method for rapidly and accurately identifying the symbols associated with balls drawn in the play of a game of chance.

An apparatus according to the invention includes a ball transport arrangement, a reader unit including a transmitter and receiver, and a transponder mounted within each ball which may be drawn. The transport arrangement receives a series of balls at random from a mixer unit and positions each ball in a reading position. The reader transmitter transmits an energizing signal to each ball when the ball is in the reading position. In response to the energizing signal, the transponder associated with the respective ball transmits an identifying signal which includes a unique identifier such as a number or other symbol. The receiver associated with the reader unit receives the identifying signal and preferably passes the identifying information on to be displayed for the game operator, the game players, or both.

The transport arrangement preferably includes a number of interconnected tubes for receiving the balls to be identified, positioning each ball in the reading position, displaying the drawn balls, and after a particular game sequence, returning the balls to the mixer unit. The series of tubes may include a receiver tube, a queuing tube, a reading tube, and a display tube. The receiving tube receives a series of balls to be identified from the mixing unit and directs the series of balls to the queuing tube which positions the drawn balls to be passed one-by-one to the reading tube. After the unique symbol associated with a particular ball is read while the ball is in the reading tube, the ball is directed from the reading tube to the display tube. The balls collect and are displayed in the display tube for the remainder of the game sequence.

A control system associated with the transport arrangement includes a series of gates for controlling the movement of the balls through the transport arrangement. The preferred control system may include first and second queuing gates for isolating individual balls from the series of drawn balls so that one ball at a time may be passed to the reading tube. A reading gate holds each isolated ball in the reading tube for a desired interrogation period sufficient to allow the reader unit to receive the identifying signal from the particular ball. A display gate holds the series of balls in the display tube until the particular game sequence is completed, and then allows the series of drawn balls to return to the mixer unit for a new game sequence.

The ball drawing apparatus and method according to the invention has several advantages over manual ball drawing and prior automated systems. First, the present apparatus identifies the drawn balls very quickly. This allows the games to be played at a very rapid pace. Also, the present automated ball drawing system very accurately identifies the drawn balls. Furthermore, the present system greatly reduces the possibility of any tampering with the outcome of the game.

These and other objects, advantages, and features of the invention will be apparent from the following description of the preferred embodiments, considered along with the accompanying drawings.

DESCRIPTION OF THE PREFERRED EMBODIMENTS

Figure 1:
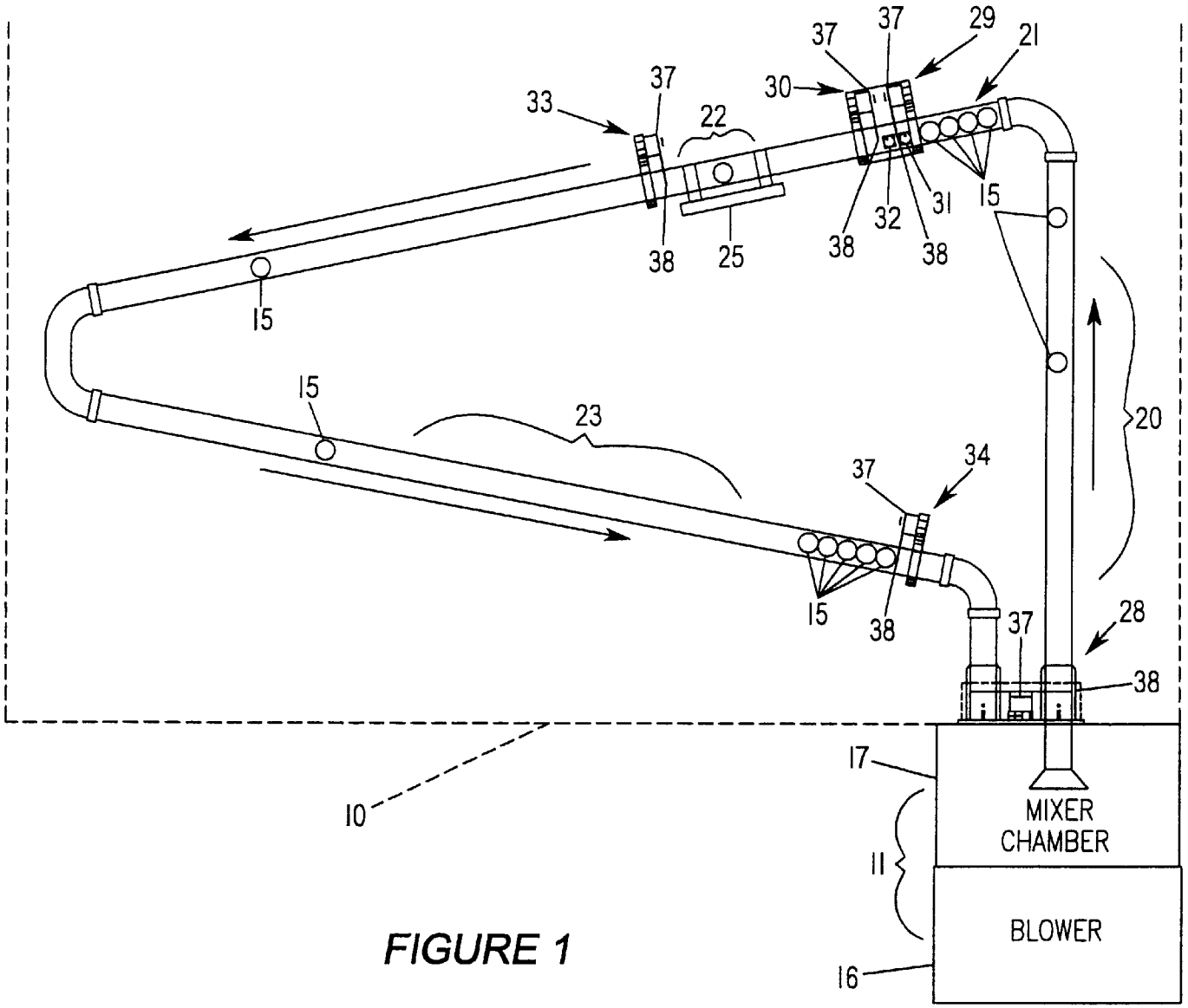
FIG. 1 is a diagrammatic representation of a ball transport arrangement for a ball drawing apparatus embodying the principles of the invention.
Figure 2:
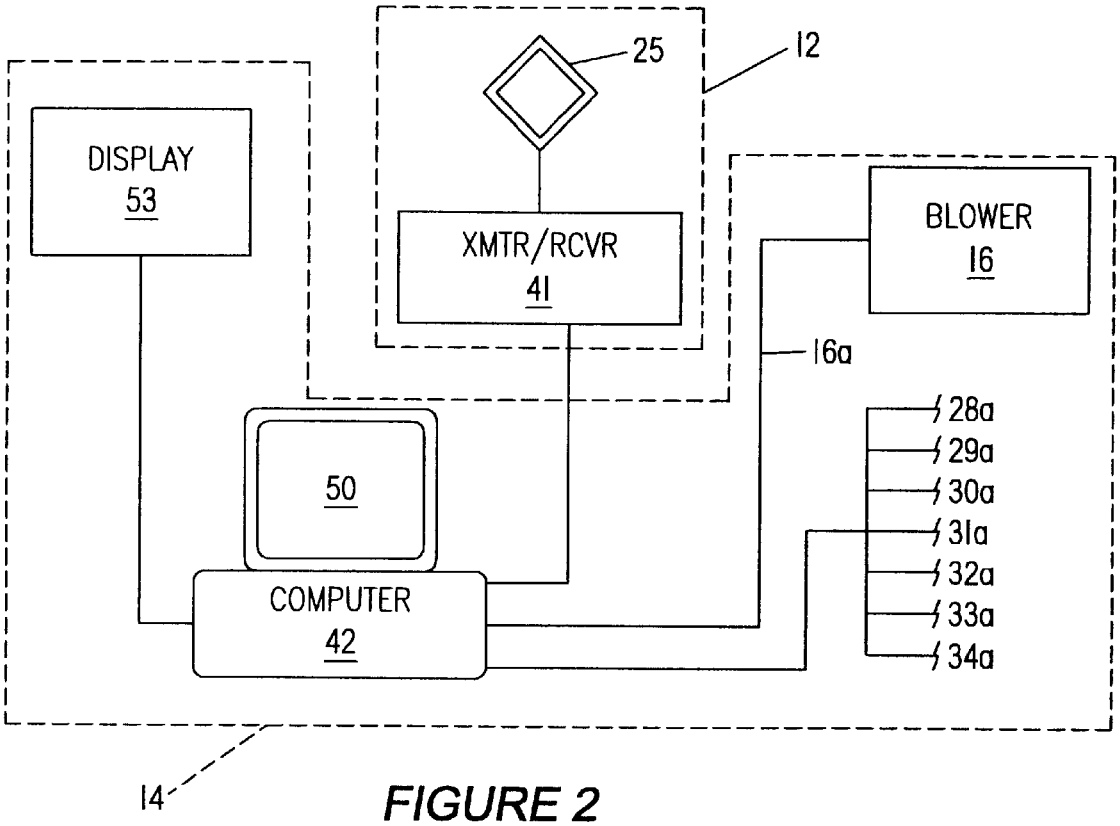
FIG. 2 is a diagrammatic representation of a reader unit and control system embodying the principles of the invention.
Figure 3:
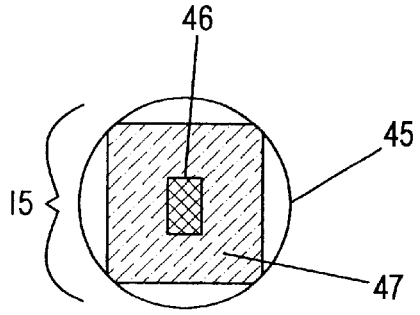
FIG. 3 is a view in section through a ball used in the ball drawing apparatus shown in FIGS. 1 and 2

FIGS. 1 through 3 show the components of one preferred form of ball drawing apparatus embodying the principles of invention. The apparatus includes a transport arrangement 10 shown in the dashed box in FIG. 1. The apparatus also includes a ball mixer arrangement shown generally at reference numeral 11 in FIG. 1. Referring to FIG. 2, the apparatus according to the present invention also includes a reader unit 12 and a control system 14. The illustrated apparatus draws a series of balls at random and reads an identifier associated with each ball. A ball which may be used in the invention is shown in FIG. 3 at reference numeral 15.

Referring to FIG. 1, ball mixer arrangement 11 includes a blower 16 and a mixing chamber 17. Mixing chamber 17 is adapted to be loaded with a plurality of balls similar to the ball 15 shown in FIG. 3. Blower 16 directs a stream of air into mixing chamber 17 to mix the plurality of balls in the chamber and also to deliver balls at random to transport arrangement 10.

Transport arrangement 10 includes a receiving tube 20, a queuing tube 21, a reading tube 22, and a display tube 23. Each tube has an internal diameter sufficient to accommodate only a single ball at any point along the length of the respective tube. Thus, balls 15 may only pass through the tubes serially, one ball at a time. Receiving tube 20 receives balls 15 from mixing chamber 17 and delivers the balls to queuing tube 21. Balls 15 pass one at a time from queuing tube 21 to reading tube 22 where each ball is held in a reading position and read using antenna 25 as will be discussed below. From reading tube 22, each ball 15 passes to display tube 23 where the balls drawn for a particular game sequence are collected and displayed in the order drawn. The tubes may be made of any suitable material including a suitable plastic. At least the display tube 23 and preferably all of the tubes are made from a transparent material to allow the system operator to monitor the progress of balls 15 through the transport arrangement.

Transport arrangement 10 also includes a series of gates, shown generally at reference numerals 28, 29, 30, 33, and 34, and further includes sensors 31 and 32. These gates and sensors are used in controlling the progress of balls 15 through the tubes 20 through 23.

A mixer gate 28 controls the movement of balls 15 from mixing chamber 17 to receiving tube 20, while first and second queuing gates, 29 and 30 respectively, control the movement of balls from queuing tube 21 to reading tube 22. In the illustrated form of the present invention, the distance between first queuing gate 29 and second queuing gate 30 is sufficient to accommodate only a single ball 15. Queuing gates 29 and 30 are controlled using sensor signals from first and second queuing sensors, 31 and 32, respectively. These queuing sensors may comprise any suitable type of sensor device, and preferably comprise photoelectric sensors. A reading gate 33 is operated to hold a ball 15 in the reading position in reading tube 22. Finally, a display gate 34 holds a series of balls in display tube 23.

Each gate 28, 29, 30, 33, and 34, preferably includes an actuator device 37 and a gate member 38. In a closed position, the gate member 38 extends into the respective tube sufficiently to block the passage of a ball 15 at that point. In an opened position, the gate member 38 is retracted from the tube sufficiently to allow a ball 15 to pass through the tube. Actuator device 37 comprises any suitable mechanism for moving its respective gate member 38 between the open and closed positions. For example, each actuator device may comprise a solenoid. In the preferred form of the invention, each actuator device 37 associated with gates 29, 30, 33, and 34 is biased to hold the respective gate member 38 in the closed position, and moves the gate member to an open position only when it receives a solenoid energizing signal from the control system 14 shown in FIG. 2. The actuator device 37 associated with mixer gate 28 is preferably biased to hold the respective gate member 38 in the open position. The invention is, however, not limited to any particular gate member biasing arrangement.

Those skilled in the art will appreciate that the tube-type transport arrangement 10 shown in FIG. 1 may also include a support arrangement. This support arrangement is omitted from the drawing so as not to obscure the invention in unnecessary detail, and simply holds the tubes in the position shown in FIG. 1 to allow balls 15 to gravity feed from one tube to the next. Also, although the tube-type transport arrangement is preferred, any other arrangement may be used to receive a series of balls at random and place each ball in position to be read according to the invention. Any such alternate arrangement is to be considered an equivalent to the illustrated tube-type structure for purposes of the following claims.

Referring to FIG. 2, the reader unit 12 comprises a transmitter/receiver 41 connected to antenna 25 and a computer 42 associated with the control system 14. Referring to FIG. 3, each ball 15 which may be used according to the present invention preferably includes a shell 45 and a transponder 46 suspended in the shell with a suitable material 47. Material 47 is preferably an elastomeric foam. A number or other identifying symbol (not shown) is printed preferably at several different locations on the exterior surface of each ball 15. Transponder 46 may, for example, comprise a model RI-TRP-W9WK transponder produced by Texas Instruments Company, Inc. The transponder 46 mounted in each ball 15 is programmed with a unique identifier which may be used to identify the symbol printed on the ball. In some cases, the identifier may comprise the printed symbol itself. In other cases the identifier may comprise some other symbol and may need to be translated to produce the symbol printed on the ball. In any event, although the transponder model described above is programmable, transponders with fixed identifiers may be used within the scope of the present invention and are to be considered equivalents to programmable transponders for purposes of the following claims.

When a ball 15 is in the reading position in reading tube 22, transmitter/receiver 41 transmits an energizing signal through antenna 25. The transponder 46 associated with the respective ball 15 responds to the energizing signal by transmitting an identifying signal containing or representing the pre-programmed unique identifier. Immediately after transmitting the energizing signal, transmitter/receiver 41 receives the identifying signal transmitted by the transponder 46. The identifier contained in this signal is then passed to control system 14 shown in FIG. 2.

Transmitter/receiver 41 may be operated in a number of different fashions to provide the desired ball identifying information to control system 14. For example, transmitter/receiver 41 may send a single energizing signal to a ball 15 in the reading position. In the preferred form of the invention, however, transmitter/receiver 41 cycles repeatedly between its transmitting and receiving modes. Thus, transmitter/receiver 41 may receive many identifying signals from the single ball held in the reading position in reading tube 22. Logic associated with the transmitter/receiver 41 or control system 14 may consider a transmitted identifying signal valid only when an identifying signal is repeatedly read from a single ball 15. Any variations in the number of cycles the transmitter/receiver 41 uses to identify a ball 15 should be considered as being within the scope of the invention defined in the following claims.

Computer 42 preferably comprises a suitable personal computer with a suitable operator display 50 and suitable input devices such as a keyboard and mouse (not shown). Computer 42 also includes an input/output device (not shown) for receiving inputs from the reader unit 12 and sensors 31 and 32, and for providing control signals to the gates 28, 29, 30, 33, and 34. For example, computer 42 may include a RS232 serial port for communicating with transmitter/receiver 41, and a standard PCISA input/output card for communicating with sensors 31 and 32, and gates 28, 29, 30, 33, and 34. Control system 14 may also have associated with it a player display 53 or several such displays for displaying the symbols associated with balls drawn over the course of a game sequence. The invention is of particular use in a bingo game system which includes a number of game terminals (not shown). Each player plays the game on their respective terminal and may communicate with the game operator through the terminal. Each player terminal also includes a display for displaying to each player the symbols drawn in a particular game sequence.

Figure 4A:
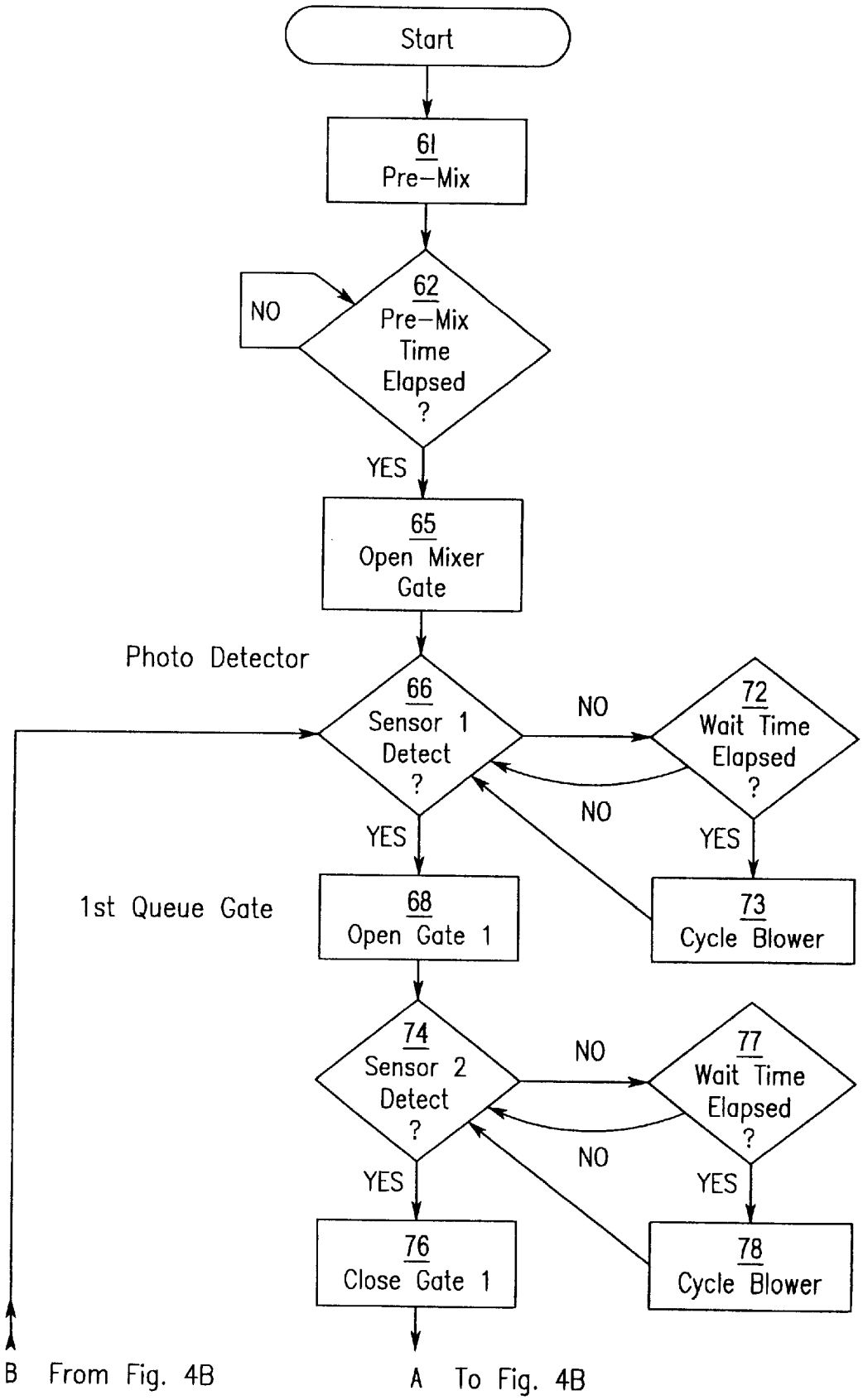
FIG. 4A is a block diagram showing a portion of the control process utilized in the apparatus shown in FIG. 1.

The operation of the ball drawing apparatus shown in FIGS. 1 through 3 and the method of the invention may be described with reference to the block diagrams of FIGS. 4A and 4B. These figures show a control process which is implemented by software instructions executed by the control system computer 42. Referring to FIG. 4A, a game sequence is initiated by a start signal which is preferably applied manually by the game operator. After starting the game sequence, the control system 14 at block 61 activates the blower 16 through line 16*a* (FIG. 2) to premix the plurality of balls 15 loaded in mixing chamber 17. Mixer gate remains closed during this premixing period. At block 62, the process checks for the passage of a predetermined premix time. If the predetermined premix time has elapsed since the blower was activated, the control system 14 at block 65 sends a signal through control line 28*a* to open mixer gate 28, allowing balls 15 from mixing chamber 17 to be blown through receiving tube 20 into queuing tube 21. The first ball 15 stops at first queuing gate 29 which is closed at this point. It will be noted that since the mixer gate 28 is preferably biased open, the signal on control line 28*a* to open the gate comprises a signal which deactivates the solenoid 37 associated with gate 28, allowing the gate member 38 to return to the open position.

After opening the mixer gate 28, the process at block 66 checks first queuing sensor 31 through the signal on sensor line 31*a* to determine if a ball 15 is positioned at first queuing gate 29. If a ball is detected by first queuing sensor 31, control system 14 at block 68 sends a signal through line 29*a* to open first queuing gate 29 and allow the ball to pass into the portion of queuing tube 21 between the first queuing gate and second queuing gate 30. However, if no ball is detected at decision block 66, the process loops to decision block 72 to determine if a pre-defined waiting period has passed. If the waiting period has passed, the control system at block 73 cycles blower 16 by turning the blower off momentarily and then back on. This step is intended to clear a blockage which has prevented a ball from reaching the first queuing gate 29 in queuing tube 21.

Referring to decision block 74, the control system next checks the signal on line 32*a* from the second queuing sensor 32 to determine if a ball is detected at the second queuing gate 30 in queuing tube 21. A positive sensor signal indicates that a ball is in position between first queuing gate 29 and second queuing gate 30. Control system 14 responds at block 76 to a positive signal from second queuing sensor 32 by closing first queuing gate 29. However, if a positive signal is not received from the second queuing sensor 32 at this point, control system 14 loops to decision block 77 which determines if a predetermined waiting time has passed. If the waiting time has passed, the control system at block 78 cycles blower 16, turning the blower off and back on to clear in the apparent blockage preventing balls from reaching second queuing gate 30.

Figure 4B:
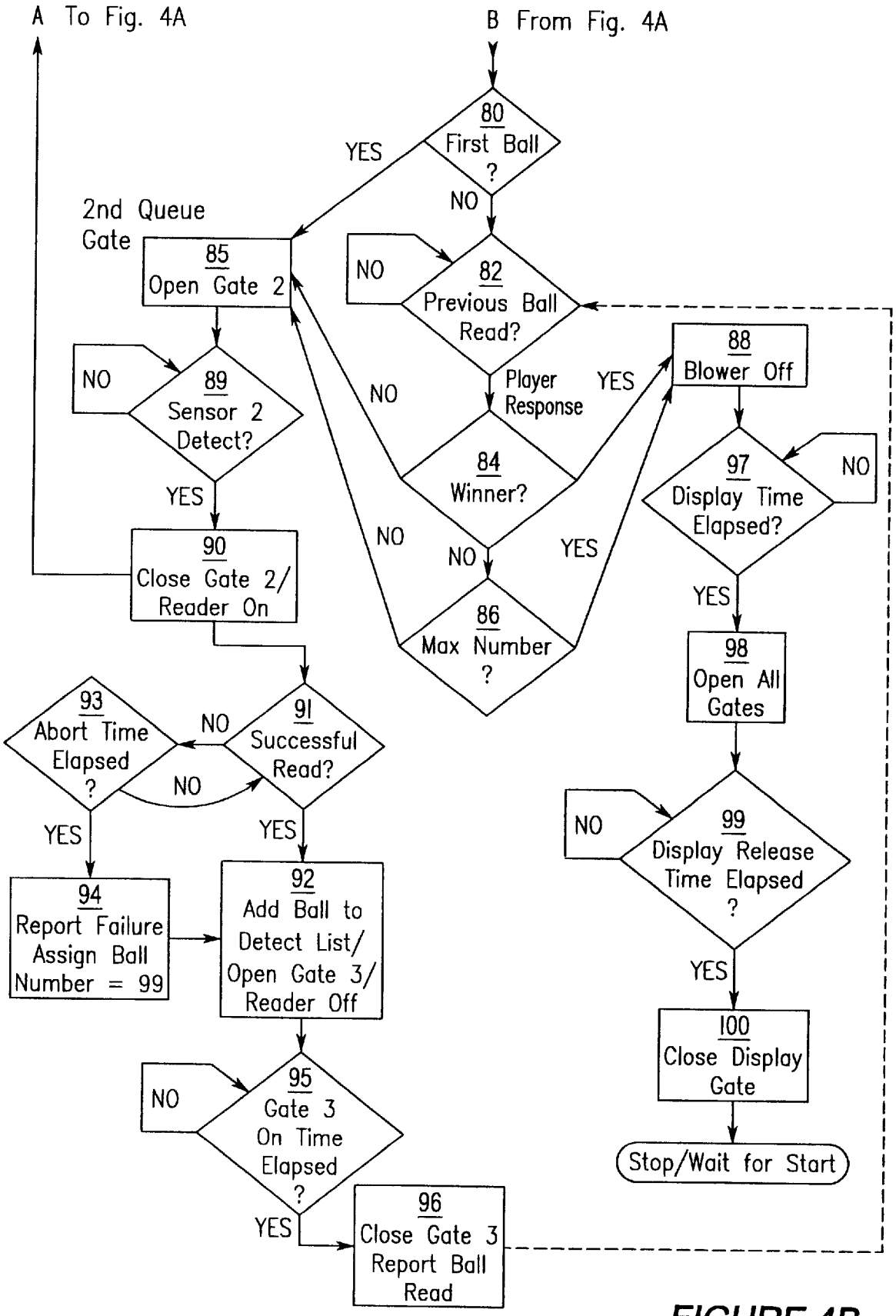
FIG. 4B is a block diagram showing the continuation of the control process shown in FIG. 4A.

After the first queuing gate 29 is closed at block 76, the process continues as shown in FIG. 4B. At decision block 80, the control system 14 determines if the ball is the first ball in the current game sequence. If it is the first ball in the game sequence, control system 14 opens the second queuing gate 30 at block 85 allowing the ball to pass into reading tube 22. If, however, the ball is not the first ball, control system 14 at block 82 checks to see if the previous ball has been read and continues to check until the previous ball has been read. Once the previous ball has been read as indicated at block 82, the process proceeds to block 84 to determine if there is a game winner. A winner indication may be applied by any suitable means including from the game operator or a player who may provide a winner indication through a player terminal. In other forms of the invention, the winner indication may be provided by some automated system.

If there is no winner indication, control system 14 responds at block 85 by using control line 30*a* to open second queuing gate 30 and allow a single ball to pass into reading tube 22. Also, control system 14 preferably checks at decision block 86 to see if the maximum number of balls have been drawn for a particular game sequence. If the maximum number of balls have been drawn, the process loops to an end sequence beginning at block 88.

After opening second queuing gate 30, the system at block 89 preferably checks the second queuing sensor 32 through sensor line 32*a* to make sure the ball has been released from queuing tube 21 into reading tube 22. If sensor 32 fails to detect a ball, the previously held ball has been released and the control system at block 90 closes the second queuing gate and turns the reader unit on. Also, the process loops to block 66 to begin the steps for allowing the next ball into the area between first queuing gate 29 and second queuing gate 30.

When the reader is turned on at block 90 transmitter/receiver 41 transmits the energizing signal through antenna 25 and then receives the identifying signal from the transponder 46 mounted in the ball 15 positioned in reading tube 22. At block 91, control system 14 inquires to see if a ball has been successfully read. This determination may made by any suitable means including comparing a list of available identifying symbols to the symbol defined by the identifying signal which has just been received through transmitter/receiver 41. If the read operation has been successful, control system 14 at block 92 adds the detected ball to a detected list, opens reading tube gate 33 using control line 33*a*, and turns reader unit 12 off through reader unit line 12*a*. The detection list may be displayed to the operator on display 50 and may also be displayed to the game players by suitable means such as by display 53.

If at block 91 control system 14 determines that the ball has not been successfully read, the process loops to decision block 93 to determine if an abort time has elapsed since the reader 12 has been turned on. If the abort time has not elapsed, the system loops back to block 91 to determine if the ball has been successfully read. However, if the abort time has elapsed, the ball cannot be read and the system at block 94 reports a read failure to the operator by suitable means, assigns a failure indicating number to the ball such as 99, and goes to block 92. The read failure may be communicated to the operator by audible or visual alarms, or both. Reading gate 33 is opened for a long enough period of time to make sure that the ball passes from reading tube 22 to display tube 23. The time that the reading gate is open is checked at decision step 95. If the desire time as elapsed, reading gate 33 is closed preferably by removing an "open" signal from control line 33*a* and the process at block 96 reports that the ball has been read. This "successful read" signal is used at decision block 82.

The release sequence is invoked when there is a winner or a maxim number of balls have been read for a game sequence. Until the released sequence is invoked, each ball 15 which has been read collects in display tube 23 behind display gate 34. As shown in FIG. 4B, the release sequence at block 88 first turns off blower 16. The collected balls are held for a display period as determined at decision block 97 and, after the display time passes, control system 14 at block 98 opens all gates using control lines 28*a*, 29*a*, 30*a*, 33*a*, and 34*a*. This allows all balls 15 to return to mixer chamber 17. After a release period has elapsed as determined at block 99, control system 14 at command block 100 closes all gates, gates 28, 29, 30, 33, and 34. Thereafter control system 14 awaits the next start signal to start a new game sequence.

The ball reading apparatus and method according to the invention facilitates a completely automated ball drawing operation in which balls are rapidly and accurately read without human intervention or interference except for starting a game sequence. The system may be operated in either an automatic mode or a manual mode. In an automatic mode, the identity of each drawn ball is transmitted to be used in the play of the game without operator intervention. A single operator could monitor several automated ball drawing devices according to the invention, only intervening when control system 14 gives the operator a "no read" alarm (block 94 in FIG. 4B).

In the manual mode of operation, the operator checks the number of each ball drawn and enters the number into the system computer 42. The automatic ball reading feature of the automated ball drawing device serves only to confirm or validate the number entered by the operator. If the automatic reading of any ball differs from the operator's manual entry, the system alerts the operator by suitable means such as by audible and/or visual alarms. The operator must then check his previous reading and re-enter the correct ball number. In the event that the automated ball drawing device does not successfully read a particular ball, the system may produce an alarm for the operator indicating that no automatic reading was obtained.

The above described preferred embodiments are intended to illustrate the principles of the invention, but not to limit the scope of the invention. Various other embodiments and modifications to these preferred embodiments may be made by those skilled in the art without departing from the scope of the following claims.

What is claimed is:

1. A ball drawing apparatus including:

(a) a reading tube having an internal diameter sufficient to receive a ball to be read;

(b) a reading gate at an outlet end of the reading tube, the reading gate normally biased to a closed position in which the ball is prevented from exiting the reading tube, the reading gate also being movable to an open position in which the ball is enabled to exit the reading tube;

(c) a ball reader unit for reading the ball in the reading tube to provide a ball identifying signal; and (d) a control computer operatively connected to the ball reader unit and to the reading gate, the control computer receiving the ball identifying signal from the ball reader unit, determining if the ball identifying signal is valid, and signaling the reading gate to move from the closed position to the open position in response to a valid ball identifying signal from the ball reader unit.

2. The apparatus of claim 1 wherein:

(a) the ball identifying signal for the ball corresponds to an identifying symbol; and (b) the control computer determines if the ball identifying signal is valid by comparing the identifying symbol to a list of available identifying symbols.

3. The apparatus of claim 1 wherein:

(a) the ball reader unit reads the ball in the reading tube an addition time to provide an additional identifying signal; and (b) the control computer receives the additional identifying signal and compares the additional identifying signal to the ball identifying signal in determining if the ball identifying signal is valid.

4. The apparatus of claim 1 further including:

(a) a queuing tube having an internal diameter sufficient to receive the ball there through, the queuing tube having an outlet end connected to an inlet end of the reading tube;

(b) a first queuing gate positioned at a point along the length of the queuing tube;

(c) a second queuing gate positioned toward an outlet end of the queuing tube with respect to the first queuing tube and spaced apart from the first queuing gate to accommodate only the ball between said first and second queuing gates and no other ball; and (d) wherein the first queuing gate and second queuing gate are operatively connected for control by the control computer.

5. The apparatus of claim 1 further including:

(a) a display tube connected to receive the ball from an outlet end of the reading tube, the display tube having a diameter sufficient to hold the ball and a plurality of similar balls in a single line, and display tube having a transparent section through which said single line of balls is visible; and (b) a display gate at an outlet end of the display tube, adjacent to the transparent section.

6. The apparatus of claim 1 wherein the reader unit includes:

(a) a transmitter for transmitting an energizing signal to the ball when the ball is positioned in the reading tube.

7. The apparatus of claim 6 wherein the reader unit further includes:

(a) a receiver for receiving the identifying signal from the ball in the reading tube in response to the energizing signal.

8. A method for controlling a ball drawing apparatus, the method including the steps of:

(a) receiving a ball to be read in a reading tube;

(b) preventing the ball from exiting the reading tube;

(c) reading the ball in the reading tube with an automated ball reading unit to provide a ball identifying signal;

(d) determining if the ball identifying signal is valid; and (e) enabling the ball to exit the reading tube if the ball identifying signal is valid.

9. The method of claim 8 wherein the ball identifying signal for the ball corresponds to an identifying symbol, and the step of determining if the ball identifying signal is valid includes the step of:

(a) comparing the identifying symbol to a list of available identifying symbols.

10. The method of claim 8 further including the steps of:

(a) reading the ball in the reading tube an addition time to provide an additional identifying signal; and (b) comparing the additional identifying signal to the ball identifying signal in determining if the ball identifying signal is valid.

11. The method of claim 8 wherein the step of reading the ball in the reading tube includes the step of:

(a) transmitting an energizing signal to the ball when the ball is positioned in the reading tube.

12. The method of claim 11 wherein the step of reading the ball in the reading tube further includes the step of:

(a) transmitting the identifying signal from the ball in the reading tube in response to the energizing signal.

13. The method of claim 2 wherein the step of reading the ball in the reading tube further includes the step of:

(a) utilizing a receiving antenna to receive the identifying signal transmitted from the ball in the reading tube.

14. The method of claim 8 further including the step of:

(a) extending a queuing gate adjacent to an inlet end of the reading tube to isolate the ball in the reading tube from a plurality of other balls, the plurality of other balls being in position to be directed to the reading tube.

* * * * *

UNITED STATES PATENT AND TRADEMARK OFFICE

CERTIFICATE OF CORRECTION

PATENT NO. : 6,120,024
DATED : September 19, 2000
INVENTOR(S) : Jefferson C. Lind It is certified that error appears in the above-identified patent and that said Letters Patent is hereby corrected as shown below:

Claim 13, column 10, line 1 of the Patent, change number "2" to --12--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*